United States Patent [19]

Raikov

[11] Patent Number: 4,840,134

[45] Date of Patent: Jun. 20, 1989

[54] MACHINE FOR PRODUCING A TRIPLE-THREAD CHAIN STITCH FOR SEWING WEBS OVER AN EDGE

[75] Inventor: Nikolai N. Raikov, Kerch, U.S.S.R.

[73] Assignee: Tsentralnoe Proektno-Konstruktorskoe Bjuro Vsesojuznogo Rybopromyshlennogo Obiedinenia Azovo-Chernomorskogo Basseina, Sevastopol, U.S.S.R.

[21] Appl. No.: 35,732

[22] PCT Filed: Jul. 30, 1985

[86] PCT No.: PCT/SU85/00066

§ 371 Date: Mar. 25, 1987

§ 102(e) Date: Mar. 25, 1987

[87] PCT Pub. No.: WO87/00873

PCT Pub. Date: Feb. 12, 1987

[51] Int. Cl.[4] ..... D05B 1/20; D05B 57/06

[52] U.S. Cl. ..... 112/162; 112/199; 112/200

[58] Field of Search ..... 112/162, 197, 199, 168, 112/200, 177, 438, 441

[56] References Cited

U.S. PATENT DOCUMENTS

| | | | |
|---|---|---|---|
| 3,079,879 | 3/1963 | Sigoda et al. | 112/162 X |
| 4,641,592 | 2/1987 | Marchesi | 112/162 |
| 4,690,080 | 9/1987 | Mikuni et al. | 112/162 |

*Primary Examiner*—Peter Nerbun

*Attorney, Agent, or Firm*—Lilling & Greenspan

[57] ABSTRACT

A triple-thread stitch is intended for sewing webs of netting over their edges, wherein one thread (2) forms straight loops (3) and two other threads (4 and 6) form turned loops (5 and 7). In the method of producing this triple-thread stitch, performed in a machine wherein the loop-forming members are the sewing needle (8), looper needle (9) and looper hook (10), the thread (6) of the looper hook (10) is formed into a turned loop (7) which is moved about the needle (8) until the latter's thread (4) forms a turned loop (5), and driven through the straight loop (3) of the thread (2) of the looper needle (9). In the machine for sewing netting webs over their edges with a triple-thread chain stitch, the looper hook (10) is mounted for moving about the needle (8) at the side of the device (17) for advancing the webs, which provides for forming from the thread (4) of the needle (8) a turned loop (5) when the looper hook (10) moves the turned loop (7) intermediate the needle (8) and its thread (4).

5 Claims, 7 Drawing Sheets

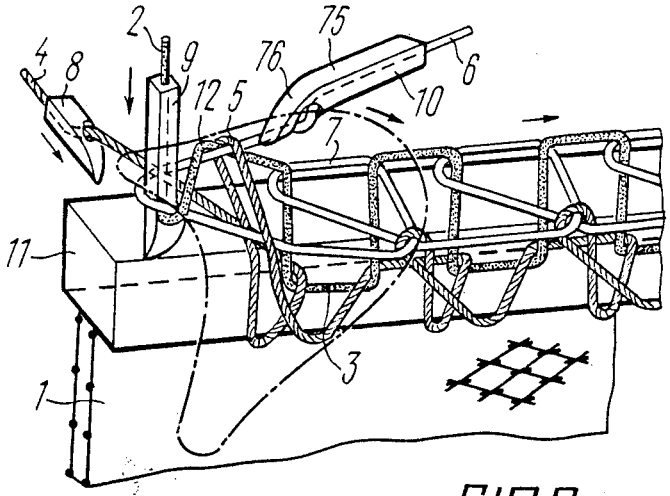
FIG.7
FIG.8
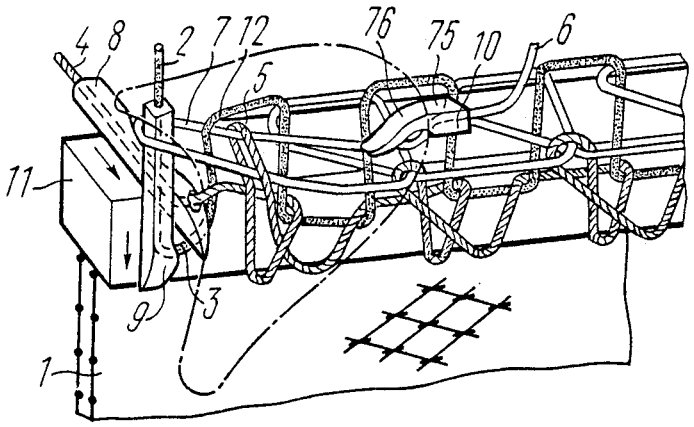

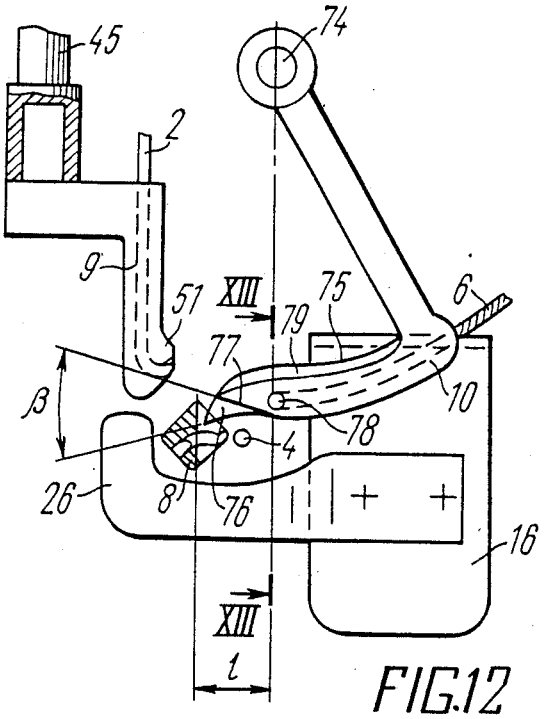
FIG.12
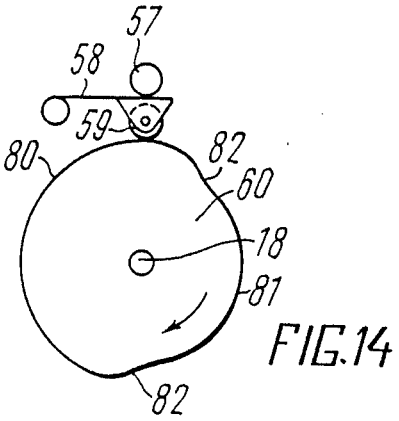
FIG.14
FIG.13
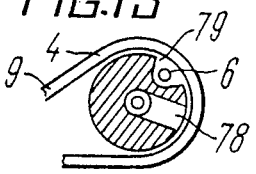

MACHINE FOR PRODUCING A TRIPLE-THREAD CHAIN STITCH FOR SEWING WEBS OVER AN EDGE

BACKGROUND OF THE INVENTION

1. Field of the Invention

The present invention relates to sewing technology, and more particularly it relates to a machine for producing triple-thread chain stitch for sewing webs over an edge.

2. Description of the Prior Art

There is known a triple-thread chain stitch, wherein the first thread is positioned at one side of the webs being sewn and forms a series of straight loops parallel with the edge of the webs, and interweaves with the second thread forming a similar series of loops at the other side of the webs, while the third thread forms straight overcasting or whip loops, each connecting two adjoining loops of one series and having its legs received in one loop of the other series (cf. F. I. Chistyakov, A. M. Nikolaenko, "Sewing Machines", Moscow, MASHINOSTROJENIE Publishers, 1976, p. 380). The knots formed by the interweaving of the first and second threads are disposed to one side of the webs, while the knots produced by the interweaving of the overcasting loops with the loops of the first and second threads are either disposed to the opposite sides of the webs or so offset that a succession of these loops is situated outside the edges, at the borderline between the webs being sewn. The legs of the straight overcasting loops are running either parallel or at a small inclination toward each other.

A known method of producing such a triple-chain stitch, performed by a sewing needle carrying the needle thread and by the first and second loppers carrying, respectively, the first and second looper threads, includes the steps of:

piercing the webs with the needle, having pulled the needle thread in advance through a loop of the first looper thread;

pulling the second looper thread through the loop of the needle thread, drawn through the webs;

pulling the first looper thread through the loop of the second looper thread; and casting the loops thus produced in succession off the loopers and tightening the stitch.

However, experience of employing this stitch for sewing fishing nets has revealed insufficient strength of the produced seams, manifesting itself in not unfrequent cases of mechanical damage of the fishing gear. The destructive effect of such damage is aggravated by the fact, when either one of the threads becomes broken, the chain stitch where all the three series of loops are straight readily loosens in the direction opposite to that of its formation.

There is further known a triple-thread chain stitch for sewing up webs over their edges, wherein the first thread forms a series of straight loops at one side of the webs being sewn, the second thread forms a series of straight loops driven through the loops of the first thread and through the webs being sewn to their other side, and the third thread forms a series of turned loops with crossing legs which project through the loops of the second thread and encompass the loops of the first thread (cf. SU Inventors' Certificate No. 820292; Int.Cl.$^3$ D 05 B 1/08, published July 30, 1983).

There is further known a method of producing such a triple-thread chain stitch for sewing webs, e.g. netting webs, over their edge, performed by successively driving the needle thread through a loop of the looper needle thread and through the webs, and subsequently driving a turned loop of the looper hook thread, through the loop of the needle thread. This yields a triple-thread stitch including two series of straight loops and one series of turned loops with crossing legs.

This method is performed by a machine comprising a framework, means for guiding the webs into the sewing zone, means for retaining the sewn up edges of the webs, a device for advancing the webs and the main shaft operatively connected with mechanisms for driving the needle mounted on a needle bar, the looper needle mounted on a rod and the hooper hook mounted in a cantilever fashion on a telescopic rotatable bar.

The telescopic rotatable bar having the looper hook mounted thereon in a cantilever fashion extends above the horizontal needle bar, running parallel therewith and belonging to one and the same plane. The looper hook in its extreme position overlies the needle at the outer side of the means for retaining the edges of the sewn webs, while the needle has its eye for outlet of the sewing needle thread facing upwardly and is freely received in the gap between the means guiding the webs into the sewing zone and means for retaining the sewn up edges of the webs.

The tip of the looper hook which is in the form of a straight hollow stem is upwardly pointed. The guiding cam of the mechanism driving the looper hook is in the form of a cylindrical disk with a valley smoothly conjugating with the cylindrical surface of the disk.

Owing to the turned loops, the third thread of a chain stitch of this type is somewhat better linked with the second thread. If the third thread is broken, its turned loops tend to tighten on the loops of the third thread, thus restraining to a certain degree the loosening of the chain stitch. This amounts to definite advantages of a stitch of this type over the first-mentioned stitch, and therefore netting webs joined by this stitch have become broadly used in the production of industrial fishing gear.

However, in this stitch, too, the knots connecting the first thread (needle thread) with the second and third threads (looper needle and looper hook threads, respectively) are formed exclusively by the interweaving of straight loops. Therefore, when either the first thread or the second one becomes broken, the chain stitch loosens as readily as in the first-described case. Furthermore, the turned loops of the third thread, interconnecting the pairs of adjacent straight loops of the second thread, are uncommonly large and would not be made smaller on account of the very structure of the seam, whereby the turned loops are all but similar to straight loops, and, consequently, inadequately effective because when the third thread becomes broken, they tighten but in some cases, and in most cases become spread giving rise to self-loosening of the seam. Thus, to prevent self-loosening of a triple-thread chain stitch of this structure used for sewing up netting webs intended for industrial fishing gear, a seam thus formed is stitched at certain intervals with an additional second seam produced manually in intermittent stitches superimposed from above upon the main seam, which steps up the input of labour into the manufacture of the fishing gear.

SUMMARY OF THE INVENTION

It is an object of the present invention to provide a machine capable of producing a triple-thread chain stitch for sewing webs over their edges wherein the loops formed are so interwoven as to provide for a loosening-proof seam upon breakage of one, two or all the three threads, thus avoiding the necessity of making an additional safety seam and allowing a step up in the productivity of operation of sewing up webs, e.g. netting webs.

This object is attained in connection with a triple-thread chain stitch for sewing webs over their edges, wherein one thread forms a series of straight loops at one side of the webs being sewn, the second thread forms a series of loops driven through the loops of the first thread and through the webs being sewn to their other side, and the third thread forms a series of turned loops with crossing legs, introduced through the loops of the second thread and encompassing the loops of the first thread, in which stitch, in accordance with the invention, the loops of the second thread are also turned, their legs crossing each other.

In the method of producing a triple-thread chain stitch for sewing webs over their edges, including the successive steps of driving the needle thread through a loop of the looper needle thread and through the webs, and subsequently driving a turned loop of the looper hook thread through a loop of the needle thread, in accordance with the invention, prior to driving the turned loop of the looper hook thread through the loop of the needle thread, the latter is moved about the needle to form from the needle thread a turned loop with crossing legs.

The disclosed structure of a triple-thread chain stitch and the method of producing it in accordance with the invention provide for a loosening-proof seam when either a single one of the threads or all the three threads become broken. Moreover, there is precluded the eventuality of either one of the three threads being accidentally pulled out, resulting in the formation of crimples in the seam, adversely affecting the operability of sewn items. This has been attained owing to the turned needle thread loops in the stitches of the seam, driven through the sewn-up webs, being narrow and closely hugging the crossing legs of the turned loops of the looper hook thread along practically their entire perimeters. Thus, when either one of the sewing threads is either broken or pulled out from the seam, the turned needle thread loops tighten on the turned loops of the looper hook thread, safeguarding each other from self-loosening and firmly holding the loops of the looper hook thread, so that the seam would not become loose.

When fishing netting is manufactured, this allows doing without superimposing upon the triple-thread stitches of the seam joining netting webs an additional intermittent safety seam made manually to prevent self-loosening of the main seam, which, in its turn, provides for stepping up the labour productivity, reducing the input of sewing thread and enhancing the performance properties of sewn articles.

A machine capable of performing the disclosed method comprises a framework having mounted thereon means for guiding webs into the sewing zone, means for retaining the sewn up edges of the webs, a device for advancing the webs and a main shaft operatively connected with mechanisms for driving the needle mounted on the needle bar. The looper needle is mounted on its rod and the looper hook mounted in a cantilever fashion on a telescopic rotatable bar. In accordance with the present invention, the looper hook is mounted for moving about the needle at the side of the device for advancing the webs, its telescopic rotatable bar being offset from the needle bar towards the device for advancing the webs and inclined to an imaginary plane including the axis of the needle and the line of stitching the edges of the webs, the needle being so mounted in the needle bar that its eye faces the device for advancing the webs, a groove being made in the needle at the same side behind the eye.

It is expedient that the inclination angle of the telescopic rotatable bar of the looper hook be within 5°–15°, and the extent by which the telescopic rotatable bar of the looper hook is offset relative to the needle bar be within one half of the length of the working portion of the looper hook.

With the machine having the disclosed structure, it is possible to perform the method of forming a loosening-proof triple-thread chain stitch by turning the loop of the needle thread prior to having the turned loop of the looper hook thread introduced thereinto.

It is possible to provide under the needle, intermediate the means for guiding the webs and the looper hook, an abutment for the needle thread, mounted on the means for retaining the sewn up edges, so as to ensure the necessary conditions for uniform tensioning of the loops of the looper needle thread and looper hook thread at the moment of the formation of a turned loop of the needle thread.

The working portion of the looper hook is preferably saddle-shaped with a tip bent downward, and the tip preferably has a share-shaped slope at an angle in a 20°–30°range, the eye of the looper hook for the outlet of the thread being preferably below the share-shaped slope at its outer side.

The bent tip of the looper thread provides for reliable engagement of the needle thread as it is pulled downwardly to underlie the needle at the moment of forming a turned loop of the needle thread and introducing into this turned loop through a turned loop of the looper hook thread. Upon the looper needle having engaged the turned loop of the looper hook thread, the looper hook readily casts off the turned loop of the needle thread owing to the saddle-like shape of its working portion. The plough-share-shape of the tip and the eye for the outlet of the looper hook thread being arranged under this tip provide for reliable passage of the looper hook over its own thread as the looper hook moves from the inner side of the webs being sewn to their outer side, precluding any wrapping of this thread about the working portion of the looper hook and eventual missing of its loop, thus enhancing the reliability of the chain stitch formation.

It is also expedient for the looper hook to have a longitudinal groove above its eye, adapted to receive therein the looper hook thread as the looper hook engages the loop of the needle thread, for this loop to slide easily onto the working portion of the looper hook.

BRIEF DESCRIPTION OF THE DRAWINGS

The invention will be further described in connection with examples of formation of a triple-thread chain stitch for sewing webs over their adges and of a method of producing this stitch, and of an embodiment of a machine for performing this method, with reference being made to the accompanying drawings, wherein:

FIGS. 2 to 8 illustrate the succession of operations of forming the triple-thread chain stitch shown in FIG. 1;

FIG. 12 shows the relative arrangement of the needle, looper needle, looper hook and abutment for the needle thread, viewed from the front;

FIG. 13 is a sectional view taken on line XIII—XIII of FIG. 12; and

FIG. 14 shows the actuating cam of the machine.

DESCRIPTION OF THE PREFERRED EMBODIMENT

Figure 1:
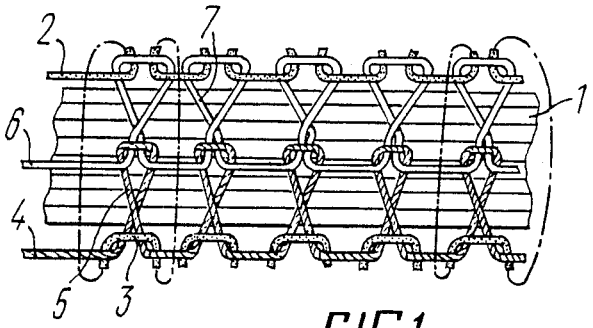
FIG. 1 is a schematic developed view of a triple-thread chain stitch in accordance with the invention.

Illustrated in FIG. 1 is a segment of a triple-thread chain stitch for sewing webs 1 over their edges in accordance with the invention, shown in a developed view. In the stitch, one of the threads—the thread 2—forms a series of straight loops 3 at one side of the webs 1 being sewn (it is at this series of loops that the view has been developed). The second thread 4 forms a series of turned loops 5 with crossing legs, introduced through the loops 3 of the first thread 2 and through the webs 1 being sewn to their other side. The third thread 6 forms a series of turned loops 7 with crossing legs, introduced through the turned loops 5 of the second thread 4 and encompassing the loops 3 of the first thread 2.

The method of forming a triple-thread chain stitch in accordance with the invention includes the following steps.

Figure 2:
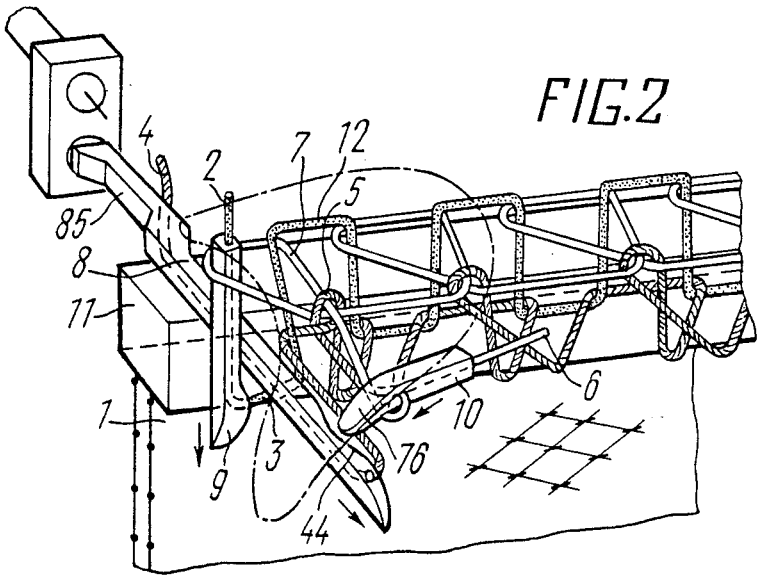
Figure 3:
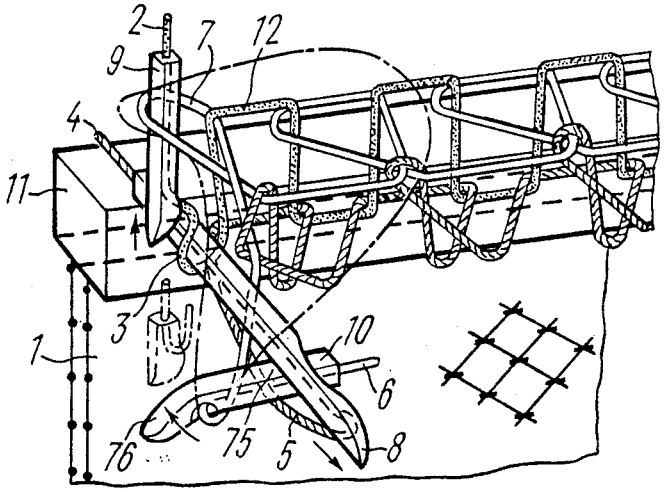
Figure 4:
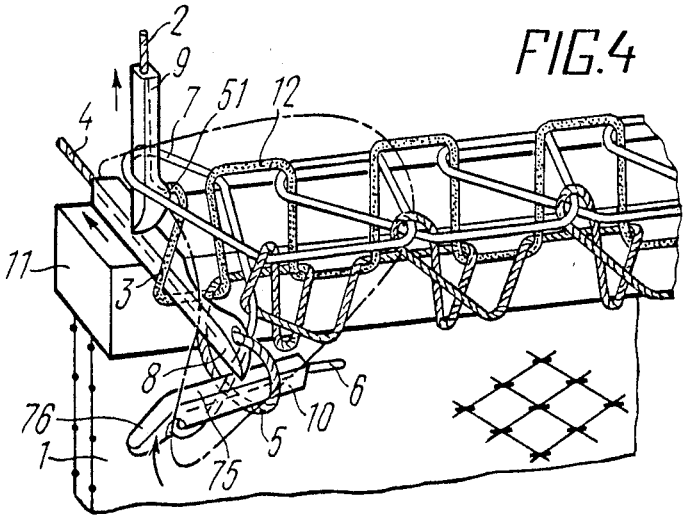

The stitch is formed with the aid of a sewing needle 8 (FIG. 2) carrying the thread 4, a looper needle 9 and a looper hook 10 carrying, respectively, the threads 2 and 6. The looper needle 9 is operated to form the loop 3 of the thread 2, disposed to one side of the webs 1 being sewn along the stitching line. The needle 8 is operated to successively introduce the thread 4 through the loop 3 of the thread 2 and through the webs 1 to their other side. The looper hook 10 is lowered upon the thread 4 and operated to drive this thread 4 to underlie the needle 8, at the same time turning the loop 5 formed of the thread 4. Then the looper hook 10 is introduced into the turned loop 5 of the needle thread 4, with the looper hook underlying the needle 8 and the thread 4 of the needle 8 underlying the looper hook 10 (FIG. 3). At the same time the looper needle 9 is driven upwardly, to form the loop 3 of the thread 2 on the needle 8. The previously formed preceding turned loop 7 of the thread 6 is retained by the looper needle 9. It is on the crossed legs of this loop 7 of the thread 6 that the closing of the preceding turned loop 5 of the needle thread 4 is commenced. Then the needle 8 is retracted backwardly, and at the same time the looper hook 10 moves about the point of the needle 8 in the upward direction (FIG. 4).

The successive turned loop 5 of the thread 4 formed during the return stroke of the needle 8 is carried over the sewn edges 11 of the webs 1, e.g. netting webs, to their other side by the looper hook 10 (FIG. 5), the edges 11 being conditionally showed in FIGS. 2 to 8 as three-dimensional square bodies for clarity sake. Meanwhile, the preceding turned loop 5 of the thread 4 is closed, its legs crossing each other. The loop 3 of the thread 2 is cast off the needle 8 and moves onto the thread 4 pulled by this needle 8. The turned loop 7 of the thread 6 of the looper hook 10 is cast off the looper needle 9 and passes onto the vertical legs of the loop 3 of the thread 2, encompassing them at their upper portion. The newly formed loop 5 of the thread 4 is thus introduced through the loop 3 of the thread 2. The thread 6 tensioned by the looper hook 10 finally forms its turned loop 7, crossing its legs. At the same time, the crossed legs of the preceding loop 5 of the thread 4 are finally tightened.

Simultaneously with the formation of the turned loop 7 of the thread 6 and the final turning and tightening of the crossed legs of the preceding loop 5 of the thread 4, there takes place the final tightening of the already formed preceding stitch. This is assisted by the advance of the netting webs 1 being sewn, effected when the needle 8 is retracted from the engagement with the webs 1.

Figure 6:
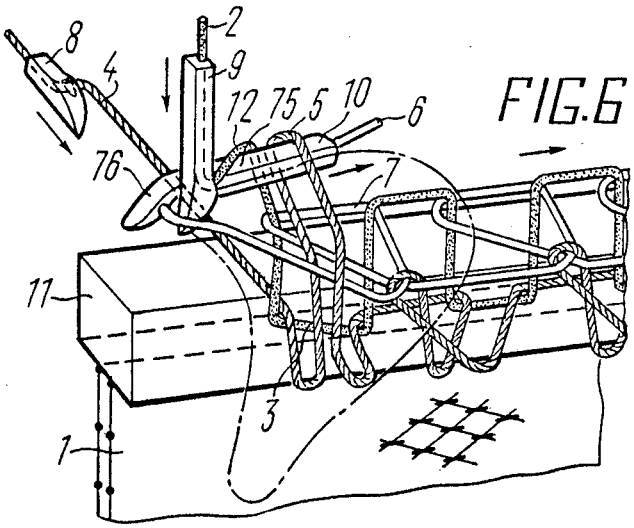

The looper hook 10 is moved under the looper needle 9 (FIG. 6). Then the looper needle 9 is moved downward and introduced between the looper hook 10 and its thread 6. The thread 2 of the looper needle 9 overlies the looper hook 10, while the webs 1 being sewn are still fed forward through the length of a stitch. Upon the looper needle 9 having engaged the successive loop 7 of the thread 6, the looper hook 10 is retracted to the right (in the drawing), with the newly-formed loop of the thread 6 of the looper hook 10 being held by the looper needle 9, the preceding turned loop of the thread 6 of the looper hook 10 and the straight loop 3 of the thread 2 being tightened (FIG. 7). The stitch 12 interconnecting the preceding and newly-formed loops 3 of the thread 2 and the turned loop 5 of the thread 4 are meanwhile retained on the moving leg of the newly-formed loop 7 of the thread 6 which is carried by the looper hook 10 over the edges of the webs 1 being sewn in the direction of the working stroke of the needle 8 (FIG. 8). The looper needle 9 with its thread 2 is introduced deeper into the loop 7 of the thread 6 of the looper hook 10, while the needle 8 with its thread 4 is moved between the looper needle 9 and its thread 2, subsequently piercing the webs 1 being sewn. Then the abovedescribed succession of steps is repeated.

The machine for performing the abovedescribed method comprises a framework 13 (FIG. 9) having mounted thereon means 14 for guiding the webs 1 into the sewing zone 15 (i.e. into the zone of the arrangement and three-dimensional motion of the loop-forming members: the sewing needle 8, looper hook 10 and looper needle 9), means 16 for retaining the sewn up edges of the webs 1, a device 17 for advancing the webs 1, and the main shaft 18 of the machine, operatively connected with mechanisms 19, 20, 21, respectively, for driving the sewing needle 8, looper needle 9 and looper hook 10.

The means 14 for guiding the webs 1 into the sewing zone 15 is mounted on the framework 13 on a bracket 22 and includes a wall 23, a lip 24 and a crosspiece 25 joining them perpendicularly.

The means 16 for retaining the sewn up edges 11 of the webs 1 is in the form of an inverted U-shaped channel member situated behind the web-guiding means 14 in the direction of the advance of the webs 1, defining therebetween the sewing zone 15. The means 16 for retaining the sewn up edges 11 is provided on the outside with an abutment 26 for the thread 4 of the sewing needle 8. The abutment 26 underlies the needle 8 and encompasses the needle 8 at the side of the web-guiding means 14.

The device 17 for advancing the webs 1 includes a driven toothed disk 27, a hanger 28 with two spring-urged weight rollers 29 mounted on a common axle 30, and an eccentric 31 with a driver. The toothed disk 27 is operatively connected through an overrunning clutch 32 mounted on the axle 33 of a connecting-rod 34 with the spherical joints 35 of a bell crank 36, and through a strap 37 with an eccentric 38 on the main shaft 18. By varying the length of the corresponding arm of the bell crank 36 connected with the spherical joint 35 the stitch length in a seam can be adjusted.

The mechanism 19 for driving the sewing needle 8 includes a needle bar 39 mounted perpendicularly to the wall 23 of the means 14 for guiding the webs 1 into the sewing zone 15, associated with a frame 40, and an accentric 41 fast on the main shaft 18, received in the frame 40 for engagement therewith. The needle bar 39 carries a holder 42 in which the needle 8 is releasably secured. The needle 8 has made therein an eye 43 for the thread 4 and a groove 44 for the passage of the looper hook 10, made intermediate the eye 43 and holder 42 at the side of the eye 43. The needle 8 is secured in the holder holder 42 for its eye 43 to face the web-advancing device 17.

Figure 10:
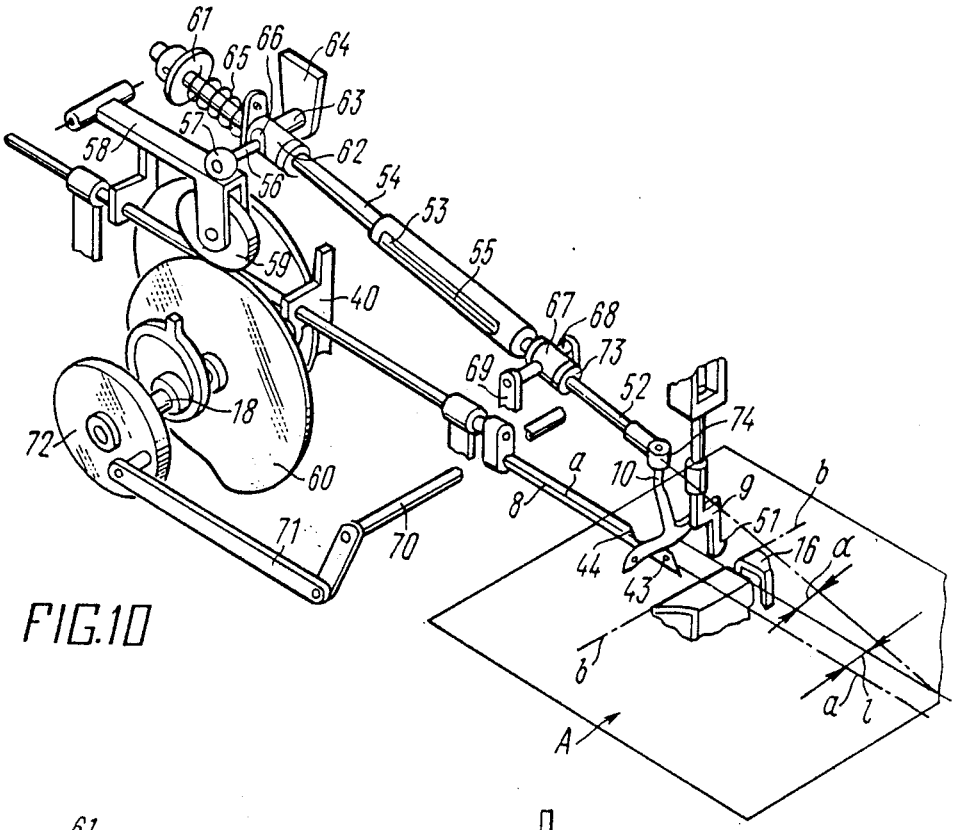
FIG. 10 illustrates the relative arrangement of the looping mechanisms, corresponding to the initial or home position of the looper hook.
Figure 11:
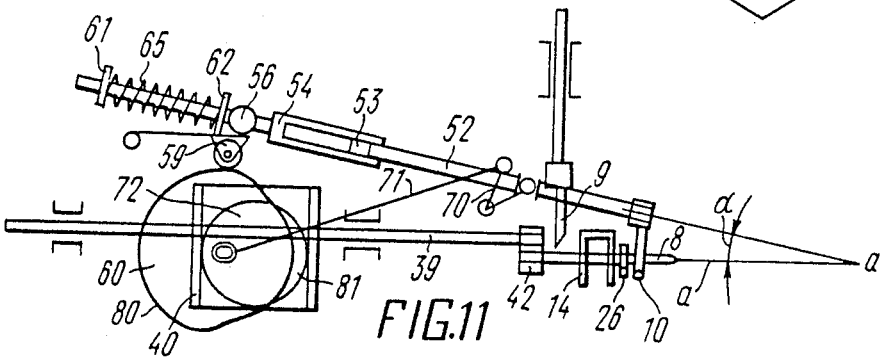
FIG. 11 schematically shows a side view of the relative arrangement of the needle, looper needle and looper hook, with the looper hook being in its fully extended position.

The mechanism 20 for driving the looper needle 9 includes a rod 45 mounted for reciprocation in a guide frame 46, a link 47, a rocker arm 48 and a strap 49 pivotally connected to one another. The main shaft 18 carries an eccentric 50 received in the strap 49. The rod 45 has secured therein the looper needle 9 having a projection or lug 51 (FIGS 10 and 11) for guiding the thread 2 normally from the looper needle 9 towards the means 16 for retaining the sewn-up edges 11.

The mechanism 21 for driving the looper hook 10 includes a rod 52 with a key 53 and a tubular guide 54 with a keyway slit 55, defining jointly a rotatable telescopic bar, a transverse arm 56 with a follower 57 mounted on the tubular guide 54, and an intermediate arm 58 carrying a follower 59 engaging a cam 60 fast with the main shaft 18. The tubular guide 54 further supports an adjustment washer 61, a sleeve 62 mounted with the aid of a pivot 63 on a bracket 64 of the machine, and spring 65 interconnecting the adjustment washer 61 and the sleeve 62. The sleeve 62 has a port 66 made therethrough for rotation of the transverse arm 56. The rod 52 supports a movable sleeve 67, pivotally connected with the aid of a transverse pivot 68, through the fork 69 of a rocker arm 70 and a connecting-rod 71 to a crank 72 made integral with the driving pulley of the machine, fast on the main shaft 18. Lock washers 73 at both ends of the sleeve 67 retain it against longitudinal displacement on the rod 52.

Figure 9:
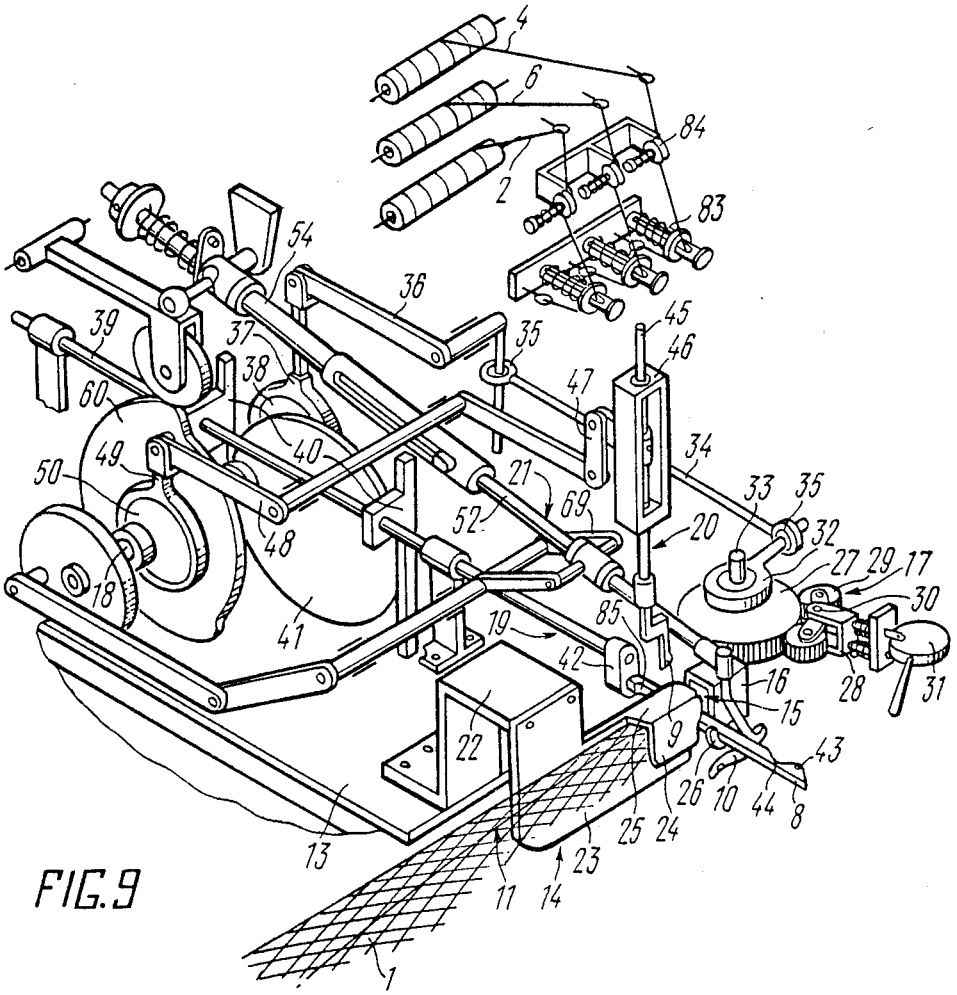
FIG. 9 schematically illustrates a mechanical diagram of a machine for performing the disclosed method of forming a triple-thread chain stitch for sewing webs over their edges.

The rod 52 carries a holder 74 wherein the looper hook 10 is secured in a cantilever fashion for moving about the sewing needle 8 at the side of the web-advancing device 17 (FIG. 9). The telescopic rotatable bar made of the rod 52 and its tubular guide 54 is offset relative to the needle bar 39 in the direction towards the web-advancing device 17, and is inclined with respect to an imaginary plane A (FIG. 10) including the axis a—a of the needle 8 and the line b—b of stitching the edges 11 of the webs 1, at an angle $\alpha$ equalling 5°-15°, whereas the distance "1" (FIG. 12) through which the telescopic rotatable bar of the looper hook 10 is offset relative to the needle bar 39 is selected so as not to exceed one half of the length of the working portion 75 of the looper hook 10. The angle $\alpha$ equalling 5°-15° is selected so that the looper hook 10 in its initial or home position behind the looper needle 9 should be above the needle 8, and in its position on the outside of the web-guiding means 14 below the needle 8.

The extent "l" of the offset of the bar of the looper hook 10 relative to the needle bar 39 is selected so that the looper hook should rotate alternatingly through identical angles about a vertical line including its axis of rotation, to provide optimized conditions for both taking and casting off the loop 5 of the thread 4.

For easier sliding of the loop 5 of the thread 4 along the working portion 75 of the looper hook 10, the portion 75 is saddle-shaped, reproducing the arc along which the looper hook 10 rotates about the axis of the telescopic bar. The tip 76 of the looper hook 10 is bent downwardly and has a slope 77 at an angle $\beta$ to the bottom generatrix of the tip, equalling 20°-30°.

The value of the angle $\beta$ in the 20° to 30° range is selected so that the edge of the slope 77 of the downwardly bent tip 76 of the looper hook 10 should be either at the level of or slightly above the eye 78 for the thread 6, so that the thread 6 should pass below the looper hook 10 and not become wrapped about its working portion 75 as the looper hook 10 is moved to the outer side of the sewn webs 1, i.e. towards the working rath of the sewing needle 8.

The thread eye 78 of the looper hook 10 is situated intermediate its working portion 75 and its downwardly bent tip 76, behind the slope 77 at its bottom part. The looper hook 10 further has a groove 79 (FIG. 13) running longitudinally in its working portion 75 above the eye 78.

The cam 60 is in the form of a disk with two opposed concentric arcs 80 and 81, the radius of the arc 80 being greater than the radius of the arc 81, and the difference between these radii being selected so that the looper hook 10 driven through its working stroke should be able to enter the turned loop 5 of the thread 4 by its working portion 75, and turn through an angle sufficient for casting off the loop 5 in its home position.

The arcs 80 and 81 merge through smooth transition fields 82, one of the transition fields 82, as it can be seen in FIG. 14, being more steep to correspond to the position of casting the loop 5 formed of the thread 4 of the needle 8 off the looper hook 10, and the other field 82 sloping more gently to correspond to the position of engaging the successive loop 5 of the thread 4 as it is being formed.

The machine has three thread guides 83 (FIG. 9) associated with corresponding devices 84 for adjusting the tension, respectively, of the thread 4 supplied to the sewing needle 8, the thread 2 supplied to the looper needle 9, and the thread 6 supplied to the looper hook 10.

The sewing needle 8 has a notch 85 at its base for the passage of the looper needle 9 at the side opposite to the groove 44.

The machine operates, as follows.

The three threads 2, 4, 6 (or ropes, depending on the type of the netting webs to be sewn) are threaded through the machine from their respective three supply bobbins or spools. The threads are guided, first, through the respective tension adjustment devices 84 and thread guides 83, and then the thread 4 is guided through the sewing needle 8, the thread 2 through the looper needle 9, and the thread 6 through the looper hook 10. Then the ends of the thus guided three threads are pulled out, brought together, guided under the means 16 for retaining the sewn edges 11 of the webs 1 and about the rim of the toothed disk 27 of the web-advancing device 17, and urged thereto by the weight rollers 29, by releasing the springurged hanger 28 with the aid of the eccentric 31.

Removable straps—either of thread or of rope—tied to the endmost edge cells of the netting webs 1 to be sewn are used to guide the webs 1 between the wall 23 and lip 24 into the sewing zone, and set them properly with respect to the cross-piece 25. Then the ends of the removable straps, same as the ends of the threads in the previous step, are put between the rim of the toothed disk 27 and the weight rollers 29, by first withdrawing the rollers 29 slightly from the toothed disk 27, with the aid of the eccentric 31 and then returning them into the urging position.

The number of the rows of cells of the netting webs 1 to be sewn, selected for forming a seam, is adjusted and set by moving the means 14 for guiding the webs 1 into the sewing zone 15 relative to the sewing needle 8. A required pitch of advancing the webs is set in a known manner by varying the working length of the lower arm of the bell crank 36.

With the machine turned on, the main shaft 18 is set in motion to drive the mechanisms 19, 20, 21 actuating, respectively, the sewing needle 8, looper needle 9 and looper hook 10, and also the web-advancing device 17.

The interaction of the respective mechanisms 19, 20, 21 driving the sewing needle 8, looper needle 9 and looper hook 10 results in straight open loops 3 (FIG. 1) of the thread 2 supplied to the looper needle 9 being interwoven, same as the turned closed loops with crossing legs of the thread 4 supplied to the sewing needle 8, and the turned closed loops 7 with crossing legs of the thread 6 supplied to the looper hook 10, forming a triple-thread chain stitch seam. The loops 3 of the thread 2 are situated at one side of the webs 1 being sewn, the loops 5 of the thread 4 are passed through the cells of the webs 1, and the loops 7 of the thread 6 pass above and over the edges 11 of the webs 1 being sewn, overcasting them from above.

As the bell crank 36 is rocked by the eccentric strap 37, the toothed disk 17 is intermittently unidirectionally rotated through the overrunning clutch 32 through angular steps corresponding to the required pitch of the seam, advancing the sewing threads and the webs 1 by extents corresponding to successive stitches.

The moment the toothed disk 27 is arrested and the webs 1 halt correspondingly, the looper needle 9 moves down in a vertical plane situated at the inner side of the webs 1 being sewn, parallel with their direction of advance (FIG. 7). The needle 8 which is likewise positioned at the inner side of the webs 1 is driven through its working stroke, entering first the straight open loop 3 of the thread 2 formed by the downward motion of the looper needle 9, passing through the turned loop 7 of the thread 6 of the looper hook 10, and then piercing the webs 1 being sewn, guiding its thread 4 to their outer side. As the needle 8 appears at the outer side of the webs 1, the looper hook 10 moves above their sewn up edges 11 from the inner to outer side of the webs 1 (FIG. 2), plunges its tip 76 into the groove 44 of the sewing needle 8, situated behind the latter's eye 43, and leans upon the thread 4 to pull it down to underlie the needle 8. The turned closed loop 7 of the thread 6 of the looper hook 10, extending through the preceding tuened closed loop 5 of the thread 4, is retained in the meantime by the looper needle 9, engaging one leg of the loop 3 of the thread 2 and the looper needle 9 above the sewing needle 8 and its thread 4.

Still moving downwardly, the looper hook 10 rotates about the longitudinal axis of the telescopic bar made of the movable rod 52 and its tubular guide 54 and is driven by the cam 60 to enter the space between the needle 8 and its thread 4, the latter underlying the working portion 75 of the looper hook 10 (FIG. 3). At the same time, the looper needle 9 returns to its up position, its lug passing through the notch 85 in the sewing needle 8, and casts off the turned loop 7 of the thread 6, which passes onto both vertical legs of the loop 3 of the thread 2 retained by the needle 8. Thus, the sewing needle 8 is now inside the loop 3 of the thread 2, with the loop 7 of the thread 6 overlying the loop 3.

Figure 5:
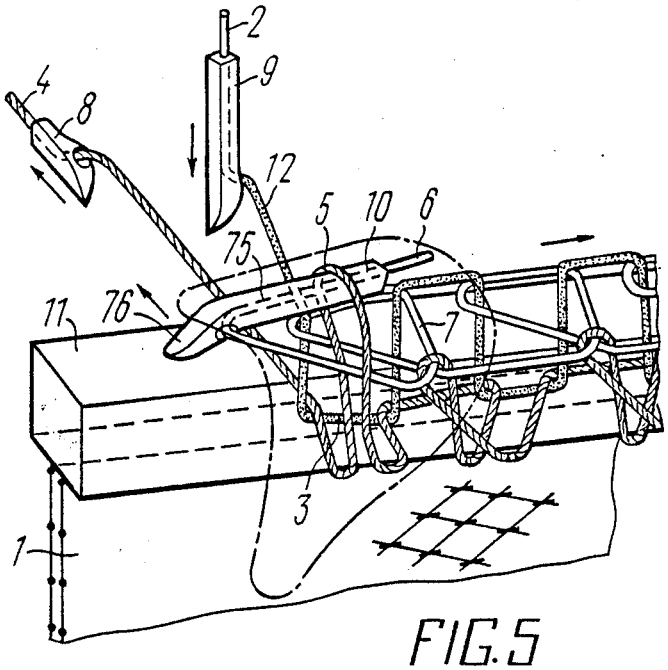

The moment the sewing needle 8 starts retreating from its fully extended working position, the looper hook 10 moves up, its working portion 75 passing about the point of the needle 8 (FIG. 4). The turned loop 5 of the thread 4 is formed on the working portion 75 of the looper hook 10, which is carried over the sewn up edges 11 of the webs 1 to their inner side (FIG. 5). The needle 8 moves out of engagement with the webs 1 which start advancing under the pull of the toothed disk 27. The straight open loop 3 of the thread 2 of the looper needle 9 is cast off the sewing needle 8 and passes onto the thread 4 pulled by the needle 8. The thread 6 pulled by the looper hook 10 forms its successive turned closed loop 7, crossing its legs. At the same time, the preceding loop 5 of the thread 4 is turned and finally closed by its legs becoming fully crossed, and the preceding fully formed stitch is finally tightened. This operation is supported by the advancing step of the webs 1.

As the mechanisms 19, 20, 21 continue their driving action, the looper hook passes by the concave part of its working portion 75 under the looper needle 9 beyond the vertical path of its travel (FIGS. 6). The looper needle 9 moves down, entering the space between the working portion 75 of the looper hook 10 and its thread 6. The thread 2 of the looper needle 9 now overlies the working portion 75 of the looper hook 10 by the stretch 12 of which one end passes through the eye of the looper needle 9 and the other end enters from above the formed preceding turned closed loop 7 of the thread 6. The webs 1 are meanwhile being advanced by the toothed disk 27, and the sewing needle 8 begins its working stroke.

Upon the looper needle 9 having engaged the loop 7 of the thread 6 of the looper hook 10, the latter is retracted from the looper needle 9 to the right (in the drawing), i.e. in the advancing direction of the webs 1 being sewn, owing to the transverse arm 56 of the telescopic bar moving from the greater-radius arc 80 (FIG. 14) of the cam 60 onto its smaller-radium arc 81.

The newly formed loop 7 (FIG. 7) of the thread 6 of the looper hook 10 is retained by the looper needle 9, while the preceding turned loop 7 of the thread 6 and loop 3 of the thread 2 of the looper needle 9 are finally tightened.

The stretch 12 of the thread 2 of the looper needle 9 and the loop 5 of the thread 4 are held on the moving leg of the newly formed loop 7 of the thread 6 being carried by the looper hook 10 over the edges 11 of the webs 1 in the direction of the working path of the needle 8 (FIG. 8). The looper needle 9 with its thread 2 moves still further into the loop 7 of the thread 6. The sewing needle 8 with its thread 4 enters the space between the looper needle 9, the thread 2 and the edges 11 of the webs 1, piercing subsequently the row of cells being stitched. The toothed disk 27 now halts, and the advancing step of the webs 1 being sewn is discontinued. The tip 76 of the looper hook 10 approaches the groove 44 of the needle 8, above the thread 4 extending from the eye 43 of the needle 8.

The abovedescribed sequence of operations of making successive stitches is then repeated.

The herein disclosed machine with a horizontally arranged sewing needle provides for sewing netting webs in a vertical position. It should be clearly understood, however, that the abovedescribed principle of operation and formation of a chain stitch can be implemented in a machine with a different (e.g. vertical) arrangement of the sewing needle, with the disclosed relative arrangement and interaction of the sewing needle, loopers and the line of advance of netting webs being substantially retained.

In this, the driving linkages of the mechanisms actuating the needle and loopers can be turned accordingly to achieve a better layout of the units of the sewing machine.

Other modifications and changes are possible without departing from the spirit and scope of the invention, as set forth in the claims to follow.

The invention can be used to the utmost effect for sewing webs of fishing nets in the manufacture of trawls, purse seines and other industrial fishing gear and implements, as well as for sewing webs of bag netting.

I claim:

1. A triple-thread stitching machine for sewing webs over their edges, comprising a framework (13) having mounted thereon means (14) for guiding the webs into a sewing zone; retaining means (16) for retaining the sewn up edges of the webs; a device (17) for advancing the webs and a main shaft (18) operatively connected with mechanisms (19, 20, 21), respectively, for driving a sewing needle (8) mounted on a needle bar (39), a looper needle (9) mounted on an associated rod (45) and a looper hook (10) mounted in a canti-lever fashion on a telescopic rotatable bar, the looper hook (10) being mounted for moving about the needle (8) at the side of the device (17) for advancing the webs, the telescopic rotatable bar being offset from the needle bar (39) towards the device (17) for advancing the webs and inclined with respect to an imaginary plane including the axis of the needle (8) and the line of stitching through the edges of the webs, the needle (8) having an eye (43) and being so mounted in the needle bar (39) that its eye (43) faces the device (17) for advancing the webs, and the needle (8) having a groove (44) made therein at the same side thereof, behind the eye (43).

2. A machine as claimed in claim 1, wherein the angle of inclination of the telescopic rotatable bar of the looper hook is in a range from 5° to 15°, and the extent (l) by which the telescopic rotatable bar of the looper hook (10) is offset relative to the needle bar (39) is selected to be within one half of the length of the working portion (75) of the looper hook (10).

3. A machine as claimed in claim 1, comprising an abutment (26) for the needle thread, situated under the needle (8) intermediate the means (14) for guiding the webs and the looper hook (10) mounted on the means (16) for retaining the sewn up edges.

4. A machine as defined in claim 2, wherein the working portion (75) of the looper hook (10) is saddle-shaped with a tip (76) bent downward, the tip having a slope (77) at an angle in a 20° to 30° range, the eye (78) of the looper hook for the outlet of the thread therefrom being below the slope (77), at the outer side thereof.

5. A machine as claimed in claim 4, wherein the looper hook (10) has an elongated groove (79) above its eye (78).

* * * * *